US011572727B2

(12) United States Patent
Eickhoff et al.

(10) Patent No.: US 11,572,727 B2
(45) Date of Patent: Feb. 7, 2023

(54) DOOR CLOSER ADJUSTMENT MECHANISM

(71) Applicant: Schlage Lock Company LLC, Carmel, IN (US)

(72) Inventors: Brian C. Eickhoff, Danville, IN (US); David V. Toloday, Martinsville, IN (US); Nagesh Varadaraju, Bangalore (IN); Aditya Heblikar, Ballari (IN); James W. Overbey, Indianapolis, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 17/235,514

(22) Filed: Apr. 20, 2021

(65) Prior Publication Data

US 2022/0003029 A1 Jan. 6, 2022

Related U.S. Application Data

(62) Division of application No. 16/398,874, filed on Apr. 30, 2019, now Pat. No. 10,982,479.

(51) Int. Cl.

| | |
|---|---|
| ***E05F 1/08*** | (2006.01) |
| ***E05F 1/10*** | (2006.01) |
| ***E05F 3/10*** | (2006.01) |

(52) U.S. Cl.

CPC ..... *E05F 1/08* (2013.01); *E05F 1/1041* (2013.01); *E05F 3/102* (2013.01); *E05Y 2900/132* (2013.01)

(58) Field of Classification Search

CPC . E05F 3/10; E05F 3/102; E05F 1/1041; E05F 1/105; E05F 1/08

See application file for complete search history.

(56) References Cited

U.S. PATENT DOCUMENTS

| | | | | |
|---|---|---|---|---|
| 3,708,826 A | | 1/1973 | Larson | |
| 3,934,307 A | | 1/1976 | Lasier et al. | |
| 4,586,739 A | | 5/1986 | Loren et al. | |
| 4,590,639 A | * | 5/1986 | Fritsche | E05F 3/10 16/DIG. 39 |
| 4,686,739 A | * | 8/1987 | Fritsche | E05F 3/10 16/64 |

(Continued)

*Primary Examiner* — Jeffrey O'Brien
(74) *Attorney, Agent, or Firm* — Taft Stettinius & Hollister LLP

(57) ABSTRACT

Certain embodiments relate to an adjustment indicator mechanism for a door closer including a tubular portion and an adjustment screw mounted to the tubular portion. A housing is configured for mounting to the door closer, and includes a channel and indicia adjacent the channel, each of the indicia corresponding to a respective size of the door closer. An adjustment transmission includes a first component configured for coupling with the adjustment screw. An indicator transmission is engaged with the adjustment transmission and mounted in the housing. An indicator is movably mounted to the housing such that a portion of the indicator is visible via the channel. The indicator is engaged with the indicator transmission such that movement of the indicator transmission causes the indicator to selectively align with the indicia to thereby indicate the current size of the door closer.

15 Claims, 12 Drawing Sheets

(56) References Cited

U.S. PATENT DOCUMENTS

| | | | | | |
|---|---|---|---|---|---|
| 4,783,882 | A * | 11/1988 | Frolov | E05F 3/00 | 16/72 |
| 4,785,493 | A * | 11/1988 | Tillmann | E05F 3/104 | 16/56 |
| 5,687,507 | A * | 11/1997 | Beran | E05F 15/63 | 74/89.37 |
| 6,282,750 | B1 * | 9/2001 | Bishop | E05F 3/10 | 16/72 |
| 8,732,905 | B2 * | 5/2014 | Bell | E05F 3/102 | 16/DIG. 39 |
| 8,819,895 | B2 * | 9/2014 | Bienek | E05F 3/223 | 16/49 |
| 9,523,230 | B2 * | 12/2016 | Burris | E05F 15/60 | |
| 9,695,620 | B2 * | 7/2017 | Zasowski | E05F 1/105 | |
| 10,180,023 | B2 * | 1/2019 | Zasowski | E05F 3/10 | |
| 10,329,820 | B2 * | 6/2019 | Hickman | E05F 3/00 | |
| 10,704,310 | B1 * | 7/2020 | Barbon | E05F 1/105 | |
| 10,815,712 | B2 * | 10/2020 | Toloday | E05F 3/12 | |
| 2011/0197391 | A1 * | 8/2011 | Yu | E05F 3/104 | 16/49 |
| 2016/0273257 | A1 * | 9/2016 | Hickman | E05F 3/10 | |
| 2019/0383080 | A1 * | 12/2019 | Barbon | E05F 3/227 | |
| 2020/0131837 | A1 * | 4/2020 | Hall | E05F 15/635 | |
| 2020/0173214 | A1 * | 6/2020 | Chin | E05F 1/08 | |
| 2020/0256108 | A1 * | 8/2020 | Shetty | E05F 3/102 | |

* cited by examiner

DOOR CLOSER ADJUSTMENT MECHANISM

CROSS REFERENCE TO RELATED APPLICATIONS

This application is a divisional of U.S. patent application Ser. No. 16/398,874 filed Apr. 30, 2019 and issued as U.S. Pat. No. 10,982,479, the contents of which are incorporated herein by reference in their entirety.

TECHNICAL FIELD

The present disclosure generally relates to adjustment indicators, and more particularly but not exclusively relates to adjustment indicator mechanisms for hydraulic door closers.

BACKGROUND

Door closers are typically installed to doors to provide a closing force that biases the door to a closed position. The strength of the closing force corresponds to the "size" of the door closer (which is typically measured on a scale of one to six), and certain existing door closers include mechanisms by which the closing force can be adjusted. While certain existing closers include adjustment indicators that indicate the strength of the closing force, many such indicators suffer from certain drawbacks, such as those related to visibility of the indicator and/or accessibility of the adjustment mechanism. For these reasons among others, there remains a need for further improvements in this technological field.

SUMMARY

An exemplary adjustment indicator mechanism is configured for use with a door closer including a tubular portion and an adjustment screw mounted to the tubular portion. The adjustment indicator mechanism includes a housing, an adjustment transmission, an indicator transmission, and an indicator. The housing is configured for mounting to the door closer, and includes a channel and indicia adjacent the channel, each of the indicia corresponding to a respective size of the door closer. The adjustment transmission includes a first component configured for coupling with the adjustment screw. The indicator transmission is engaged with the adjustment transmission and mounted in the housing. The indicator is movably mounted to the housing such that a portion of the indicator is visible via the channel. The indicator is engaged with the indicator transmission such that movement of the indicator transmission causes the indicator to selectively align with the indicia to thereby indicate the current size of the door closer. Further embodiments, forms, features, and aspects of the present application shall become apparent from the description and figures provided herewith.

DETAILED DESCRIPTION OF ILLUSTRATIVE EMBODIMENTS

Figure 1:
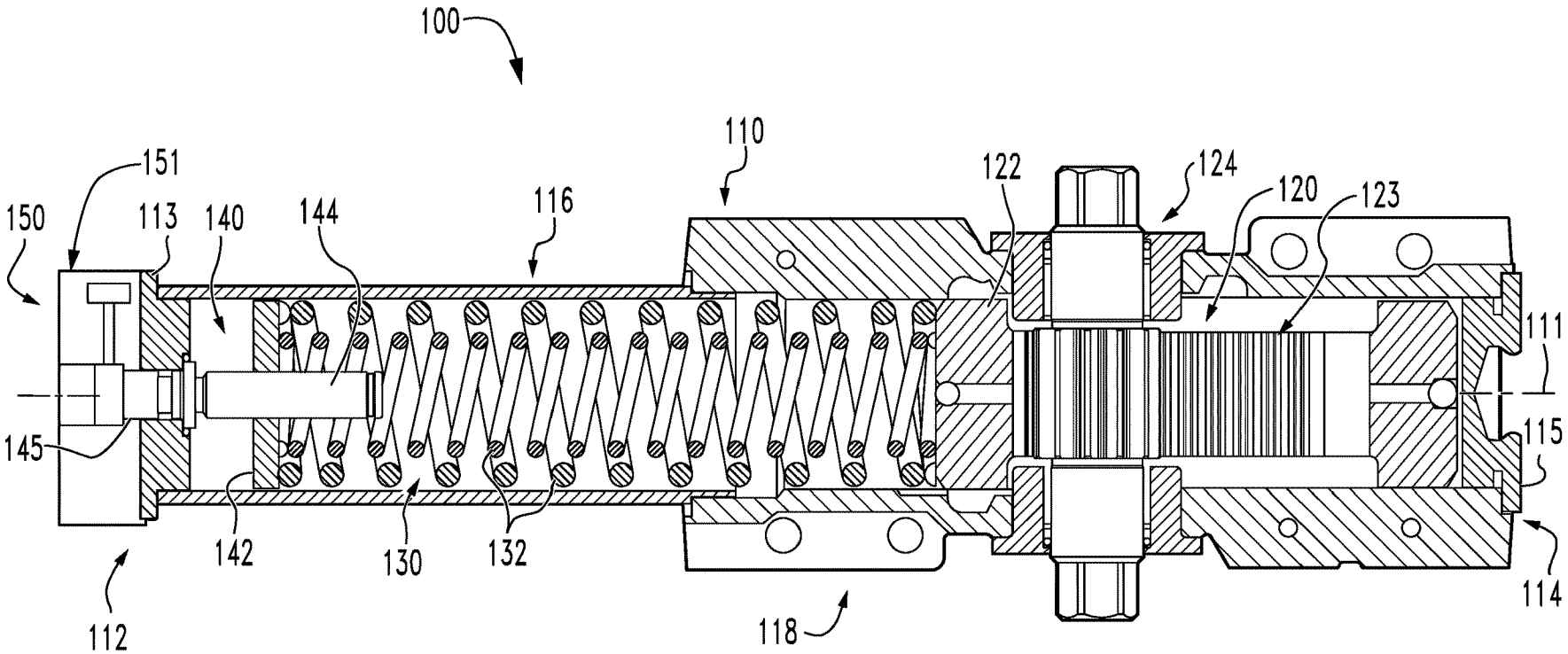
FIG. 1 is a cross-sectional illustration of a door closer according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can likewise mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a door closer 100 according to certain embodiments. The door closer 100 includes a housing 110, a rack and pinion assembly 120 mounted in the housing, a spring assembly 130 engaged with the rack and pinion assembly 120, a force adjustment mechanism 140 operable to adjust the biasing force provided by the spring assembly 130, and an adjustment indicator mechanism 150. As described herein, the "size" of the door closer 100 can be adjusted by manipulating the force adjustment mechanism 140, and the adjustment indicator mechanism 150 is configured to facilitate manipulation of the force adjustment mechanism 140 and to display indicia related to the size of the door closer 100.

The housing 110 extends along a longitudinal axis 111 between a proximal first end 112 and a distal second end 114. The first end 112 includes a proximal first end wall 113, and the second end 114 includes a distal second end wall 115. In certain forms, one or both of the end walls 113, 115 may be removable end caps. In certain embodiments, one or both of the end walls 113, 115 may be integrally formed with the housing 110. The housing 110 also includes a tubular first housing portion 116 defining the proximal end 112 and a second housing portion 118 defining the second end 114. As described herein, the rack and pinion assembly 120 is seated in the second housing portion 118, the spring assembly 130 is primarily seated in the tubular housing portion 116, and the adjustment mechanism 140 and adjustment indicator mechanism 150 are mounted to the proximal first end 112 of the housing 110.

The rack and pinion assembly 120 includes a piston 122 having a rack 123 defined thereon, and a pinion 124 engaged with the rack 123 such that linear movement of the piston 122 is correlated with rotation of the pinion 124. A door control arm is connected to the pinion 124 such that opening of the door causes rotation of the pinion 124 in a door-opening direction, thereby causing linear movement of the piston 122 in a corresponding opening direction (to the left in FIG. 1) and compression of the spring assembly 130.

The spring assembly 130 includes one or more springs 132, each of which has a first end engaged with the piston 122 and an opposite second end. For at least one of the springs 132, the second end is engaged with an anchor plate 142 of the force adjustment mechanism 140 such that the spring 132 is captured between the piston 122 and the anchor plate 142. While two springs 132 are illustrated, it is also contemplated that the spring assembly 130 may include more or fewer springs 132. Movement of the piston 122 in the opening direction compresses the springs 132, thereby storing mechanical energy in the springs 132. As a result, the springs 132 exert a closing force on the piston 122, thereby urging the pinion 124 in a closing direction opposite the opening direction. When the door becomes free to return to its closed position, the springs 132 release the stored mechanical energy by expanding, thereby driving the piston 122 in the closing direction (to the right in FIG. 1). As a result, the rack 123 drives the pinion 124 to rotate in a door-closing direction opposite the door-opening direction, thereby causing the door control arm to return the door toward its closed position.

The force adjustment mechanism 140 includes the anchor plate 142, and further includes an adjustment screw 144 that is rotatably mounted to the proximal end wall 113 such that a head 145 of the adjustment screw 144 is accessible from outside the housing 110. The adjustment screw 144 is engaged with the anchor plate 142 such that rotation of the screw 144 in opposite directions linearly drives the anchor plate 142 along the longitudinal axis 111 of the housing 110, thereby adjusting the amount by which the springs 132 are preloaded. As will be appreciated, the closing force exerted by the spring assembly 130 depends in part upon the amount of preloading applied to the springs 132, which in turn depends upon the position of the anchor plate 142 within the housing 110. Thus, the closing force provided by the closer 100 can be adjusted by rotating the adjustment screw 144 to drive the anchor plate 142 back and forth within the housing 110. More particularly, rotation of the adjustment screw 144 in a size-increasing direction compresses the spring assembly 130 and increases the size of the door closer 100. Conversely, rotation of the adjustment screw 144 in a size-decreasing direction opposite the size-increasing direction allows the spring assembly 130 to expand, thereby decreasing the size of the door closer 100. In certain embodiments, the size-increasing direction is the clockwise direction and the size-decreasing direction is the counter-clockwise direction. In other embodiments, the size-increasing direction is the counter-clockwise direction and the size-decreasing direction is the clockwise direction.

Figure 2:
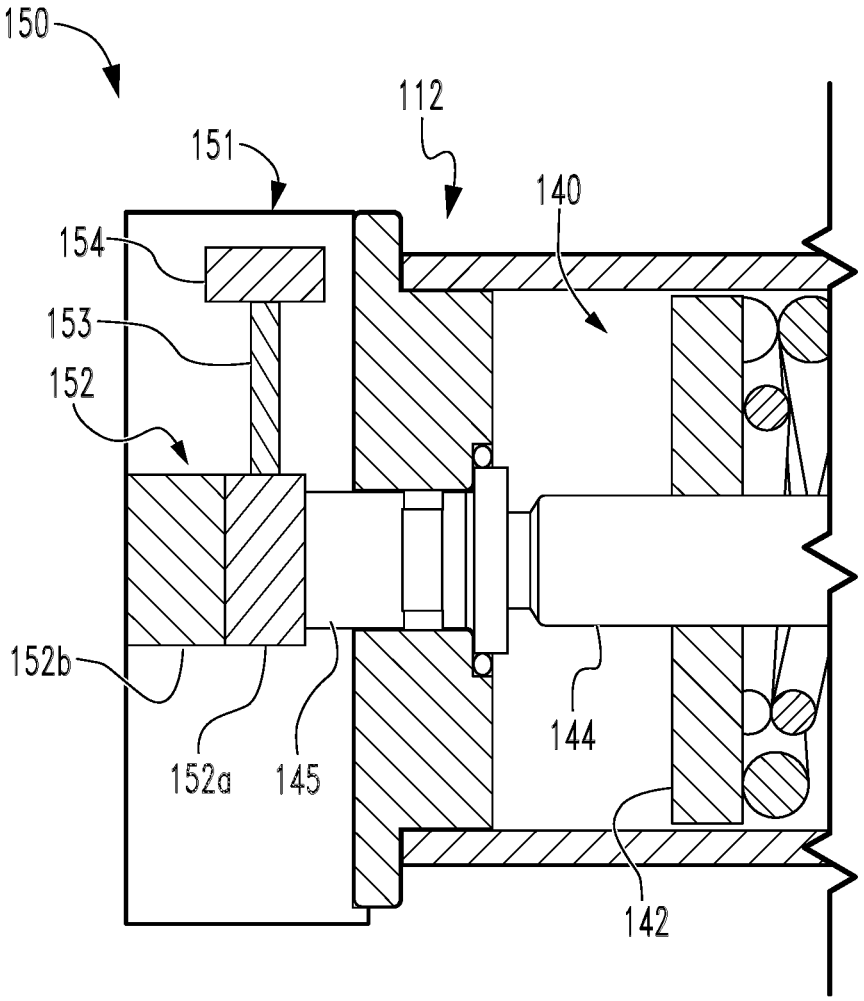
FIG. 2 is a schematic diagram of an adjustment indicator mechanism according to certain embodiments.

With additional reference to FIG. 2, the adjustment indicator mechanism 150 is configured to facilitate manipulation of the adjustment mechanism 140 and to provide a visual indication relating to the size of the closer 100. The adjustment indicator mechanism 150 generally includes a housing 151, an adjustment transmission 152 rotatably mounted to the housing 151 and engaged with the head 145 of the adjustment screw 144, an indicator transmission 153 engaged with the adjustment transmission 152, and an indicator 154 engaged with the indicator transmission 153 such that the indicator transmission 153 is operable to move the indicator 154. As described herein, manipulation of the adjustment transmission 152 rotates the adjustment screw 144 and drives the indicator transmission 153 to move the indicator 154. In certain forms, the adjustment transmission 152 may be omitted, and the adjustment screw 144 may be directly engaged by the user when adjusting the preloading of the spring assembly 130.

As described herein, the adjustment transmission 152 may include a first component **152*a* and a second component 152*b* operably engaged with the first component 152*a* such that the second component 152*b* is at least selectively capable of rotating the first component 152*a*. The first component 152*a* may be engaged with the indicator transmission 153 and/or the adjustment screw 144. The second component 152*b* may include a head operable to receive a tool for rotating the second component 152***b*. Alternatively, the second component 152*b* may include a handle by which the second component 152*b* can be manually rotated.

In certain forms, the first component 152*a* may be provided in the form of a worm gear, and the second component 152*b* may be provided in the form of a worm, for example as described below in connection with the adjustment indicator mechanisms 200, 300 illustrated in FIGS. 3-8. In certain embodiments, the first and second components 152*a*, 152*b* may be provided in the form of bevel gears, for example as described in connection with the adjustment indicator mechanism 400 illustrated in FIGS. 9 and 10. In certain embodiments, the first component 152*a* may be engaged with the second component 152*b* via a one-way bearing, for example as described in connection with the adjustment indicator mechanism 500 illustrated in FIGS. 11 and 12. In certain embodiments, the first component 152*a* may be engaged with the second component 152*b* via a ratchet-and-pawl mechanism, for example as described in connection with the adjustment indicator mechanism 600 illustrated in FIGS. 13-15.

As noted above, the indicator 154 is configured to provide a visual indication of the current size of the door closer 100, and the indicator transmission 153 is configured to move the indicator 154 in response to movement of the adjustment transmission 152. In certain forms, the housing 151 may include indicia corresponding to the available sizes of the door closer 100, and the indicator transmission 153 may include a threaded sleeve that moves the indicator 154 to selectively align with the appropriate indicium, for example as described in connection with the adjustment indicator mechanism 200 illustrated in FIGS. 3-5. In other forms, the indicator 154 may include the indicia corresponding to the available sizes of the door closer 100, and the indicator transmission 153 may selectively align the appropriate indicium with a window formed in the housing 151, for example as described in connection with the adjustment indicator mechanisms 300, 400, 500, 600 illustrated in FIGS. 6-15. As described in further detail below, both forms of the indicator 154 are capable of being used with each form of adjustment transmission 152 described herein, as well as with adjustment transmissions of other types.

In certain embodiments, the door closer 100 may include the adjustment indicator mechanism 150 at the time of sale and/or installation. In other embodiments, the adjustment indicator mechanism 150 may be a separate component configured for use with the door closer 100. For example, an adjustment indicator mechanism 150 may be selectively mounted to a first door closer 100 for adjustment of the first door closer 100, and may subsequently be removed from the first closer 100 upon completing the adjustment. The adjustment indicator mechanism 150 may then be reset and mounted to a second door closer 100 for adjustment of the second door closer 100. Certain exemplary embodiments of the adjustment indicator mechanism 150 are provided herein with reference to FIGS. 3-15.

Figure 3:
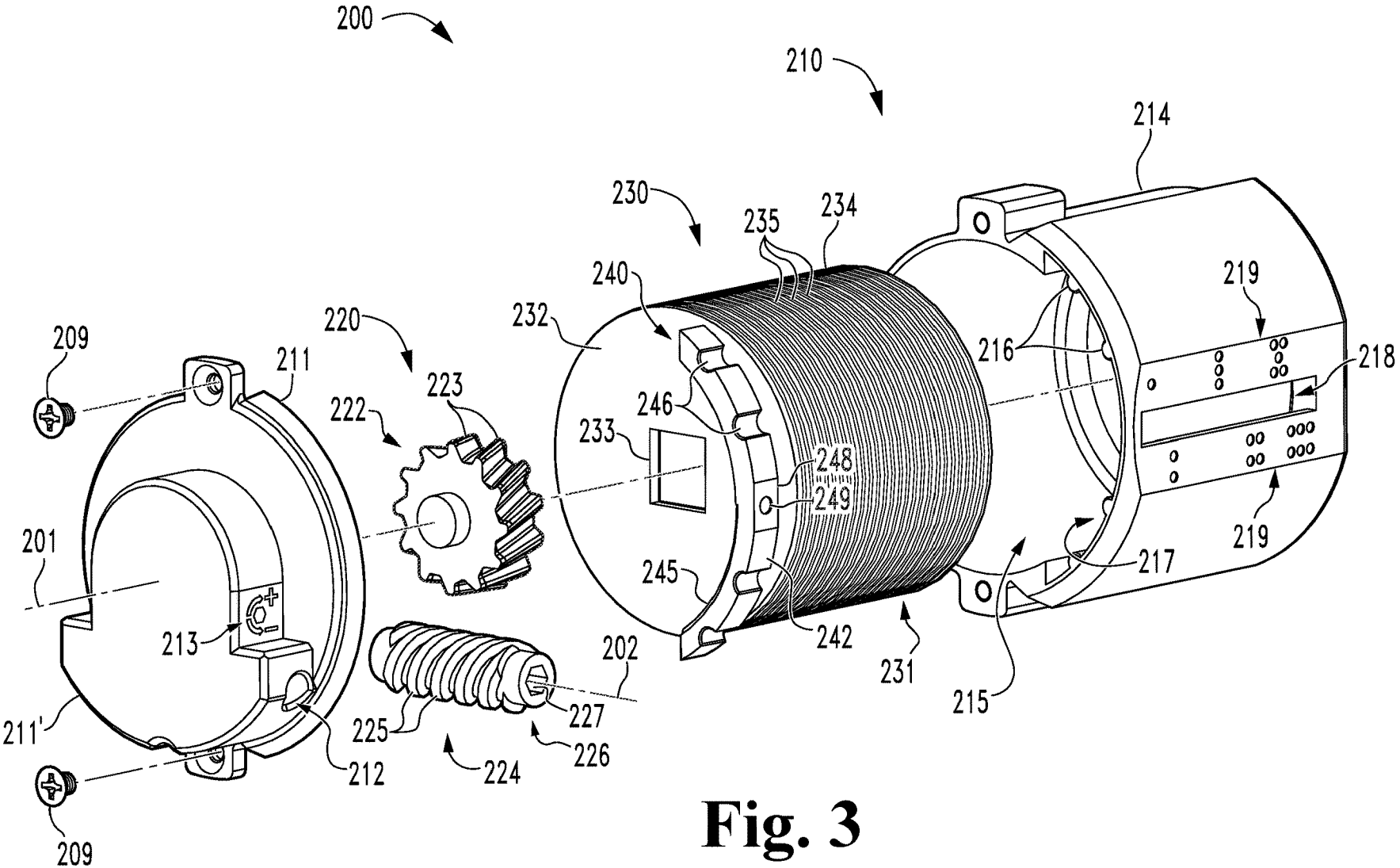
FIG. 3 is an exploded assembly view of an adjustment indicator mechanism according to certain embodiments.

With additional reference to FIG. 3, illustrated therein is an adjustment indicator mechanism 200 according to certain embodiments, which is an example of the adjustment indicator mechanism 150. The adjustment indicator mechanism 200 includes a housing 210, an adjustment transmission 220, an indicator transmission 230, and an indicator 240, which respectively correspond to the housing 151, the adjustment transmission 152, the indicator transmission 153, and the indicator 154.

The housing 210 includes an end cap 211 that is secured to a generally tubular body portion 214 by one or more fasteners 209, such as screws. The end cap 211 includes a recessed portion 211' sized and shaped to receive the adjustment transmission 220, which is movably seated in the housing 210 between the indicator transmission 230 and the end cap 211. The end cap 211 further includes an aperture 212 through which the adjustment transmission 220 can be manipulated by a tool such as a hex key. The end cap 211 may further include adjustment indicia 213 relating to the manner in which the adjustment transmission 220 can be manipulated to increase and/or decrease the size of the door closer 100. The body portion 214 defines a chamber 215 sized and shaped to receive the indicator transmission 230 and the indicator 240, and includes one or more longitudinally-extending splines 216 that extend through an arcuate recess 217. The body portion 214 also defines a longitudinal channel 218, and has a plurality of sizing indicia 219 adjacent the channel 218. As described herein, a portion of the indicator 240 is visible via the channel 218, and rotation of the indicator transmission 230 drives the indicator 240 longitudinally such that the visible portion of the indicator 240 selectively aligns with the sizing indicia 219 to indicate the current size of the closer 100.

The adjustment transmission 220 is mounted in the recessed portion 211' of the end cap 211, and generally includes a worm gear 222 mounted for rotation about a longitudinal axis 201 and a worm 224 mounted for rotation about a lateral axis 202 perpendicular to the longitudinal axis 201. The worm gear 222 includes teeth 223 that are meshed with threads 225 of the worm 224 such that rotation of the worm 224 about the lateral axis 202 causes a corresponding rotation of the worm gear 222 about the longitudinal axis 201. The rear side of the worm gear 222 is rotationally coupled with both the head 145 of the adjustment screw 144 and the end of the indicator transmission 230 such that rotation of the worm gear 222 causes rotation of the adjustment screw 144 and the indicator transmission 230. For example, the worm gear 222 may include a post 228 sized and shaped to matingly engage the head 145 of the adjustment screw 144, and a rear side of the worm gear 222 may be configured to matingly engage with a sleeve 231 of the indicator transmission 230 to rotationally couple the worm gear 222 with the sleeve 231. The worm 224 includes a head 226 defining a recess 227 sized and shaped to receive the tip of an adjustment tool, such as a hex key. The head 226 is accessible via the aperture 212 in the end cap 210 such that a user is able to insert the tip of the adjustment tool into the recess 227 to rotate the worm 224.

The indicator transmission 230 is provided in the form of a threaded sleeve 231, and includes an end wall 232 and a circumferential sidewall 234 defining a plurality of threads 235. The sleeve 231 is sized and shaped to be received between the tubular portion 116 of the closer housing 110 and the body portion 214 of the housing 210 such that the sleeve 231 is captured between the tubular portion 116 and the housing 210. The end wall 232 defines an aperture 233 through which the head 145 and/or the worm gear 222 extend such that the worm gear 222 is rotationally coupled with the adjustment screw 144 and the sleeve 231. The aperture 233 may be matingly engaged with the worm gear 222 such that the worm gear 222 and the indicator transmission 230 are coupled for joint rotation.

The indicator 240 includes an arcuate body portion 242 sized and shaped to be received in the arcuate recess 217 defined by the housing body portion 214. The radially inner side of the body portion 242 defines one or more threads 245 that engage the external threads 235 of the sleeve 231, and the radially outer side of the body portion 242 defines one or more recesses 246 that receive the splines 216 of the housing 210. The radially outer side of the body portion 242 also defines a visible portion 248 that is visible via the channel 218, and which may include an alignment indicium 249 such as a dot, an arrow, or another symbol.

Figure 4:
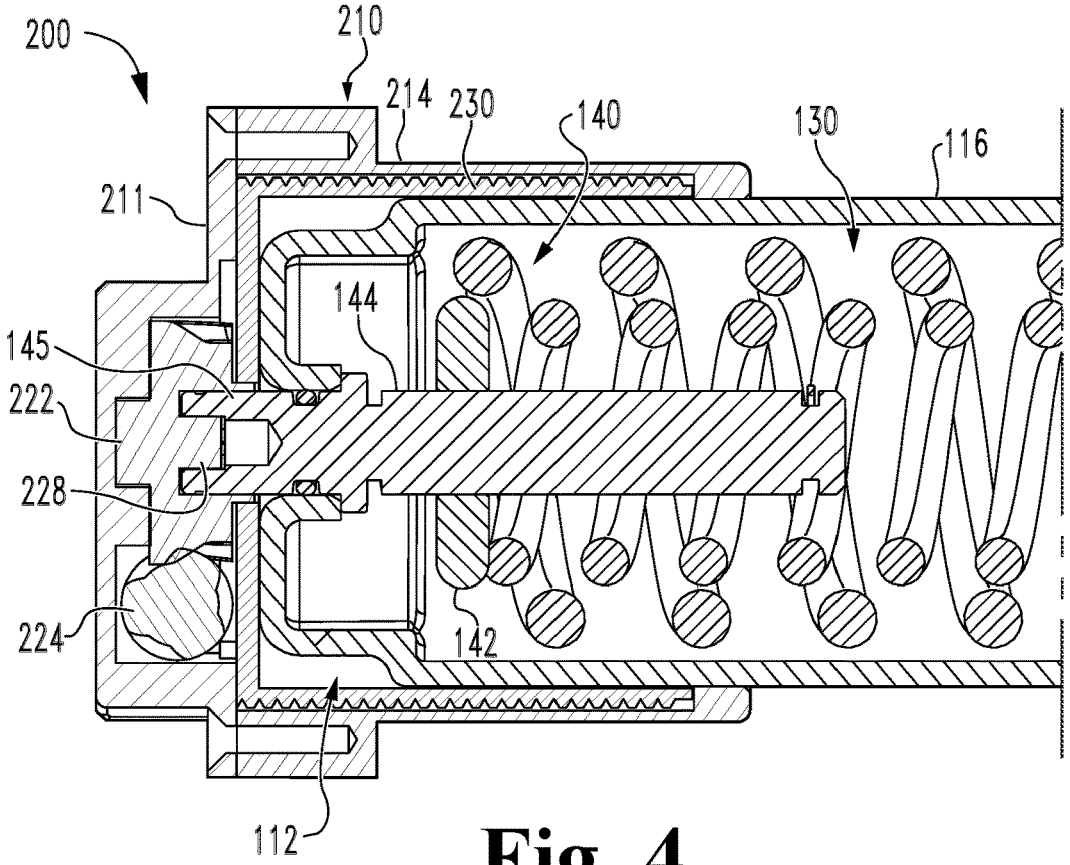
FIG. 4 is a cross-sectional illustration of the adjustment indicator mechanism illustrated in FIG. 3 installed to the door closer illustrated in FIG. 1.
Figure 5:
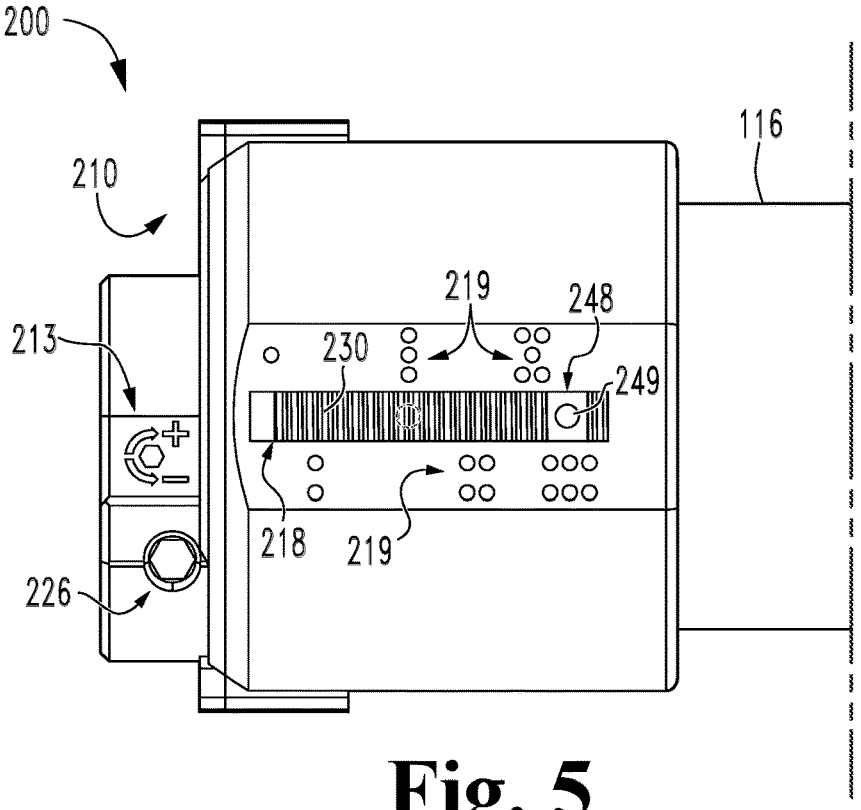
FIG. 5 is a plan view of the adjustment indicator mechanism illustrated in FIG. 3 installed to the door closer illustrated in FIG. 1.

With additional reference to FIGS. 4 and 5, the adjustment indicator mechanism 200 may be mounted to the proximal end 112 of the closer housing 110 such that the threaded sleeve 231 is rotatably supported by the tubular housing portion 116. In order to adjust the size of the door closer 100, a user may engage an adjustment tool (e.g., a hex key or screwdriver) with the worm head 226 and rotate the worm 224 in either a size-increasing direction or a size-decreasing direction opposite the size-increasing direction. The adjustment indicia 213 may indicate to the user which direction is the size-increasing direction and/or which direction is the size-decreasing direction.

Rotation of the worm 224 in the first or size-increasing direction causes the worm gear 222 to rotate the adjustment screw 144 in a corresponding direction, thereby moving the anchor plate 142 in the distal direction (i.e., away from the proximal end wall 113). As a result, the anchor plate 142 further compresses the spring assembly 130, thereby increasing the preloading of the spring assembly 130 and the size of the closer 100. Rotation of the worm gear 222 in the size-increasing direction also causes a corresponding rotation of the threaded sleeve 231, thereby causing the meshed threads 235, 245 to urge the indicator 240 in a size-increasing direction (e.g., the distal direction) while the engaged splines 216 and recesses 246 prevent rotation of the indicator 240. As a result, the visible portion 248 moves along the channel 218, and the alignment indicium 249 becomes aligned with the sizing indicium 219 corresponding to the current size of the closer 100. For example, when the size of the door closer 100 is increased to the six size, the alignment indicium 249 becomes aligned with the sizing indicium 219 corresponding to the six size, as illustrated in FIG. 5.

Rotation of the worm 224 in the second or size-decreasing direction causes the worm gear 222 to rotate the adjustment screw 144 in a corresponding direction, thereby moving the anchor plate 142 in the proximal direction (i.e., toward the proximal end wall 113). As a result, the anchor plate 142 allows the spring assembly 130 to expand, thereby decreasing the preloading of the spring assembly 130 and the size of the closer 100. Rotation of the worm gear 222 in the size-decreasing direction also causes a corresponding rotation of the threaded sleeve 231, thereby causing the meshed threads 235, 245 to urge the indicator 240 in a size-decreasing direction (e.g., the proximal direction) while the engaged splines 216 and recesses 246 prevent rotation of the indicator 240. As a result, the visible portion 248 moves along the channel 218, and the alignment indicium 249 becomes aligned with the sizing indicium 219 corresponding to the current size of the closer 100. For example, when the size of the door closer 100 is decreased to the three size, the alignment indicium 249 becomes aligned with the sizing indicium 219 corresponding to the three size, as illustrated in phantom in FIG. 5.

Figure 6:
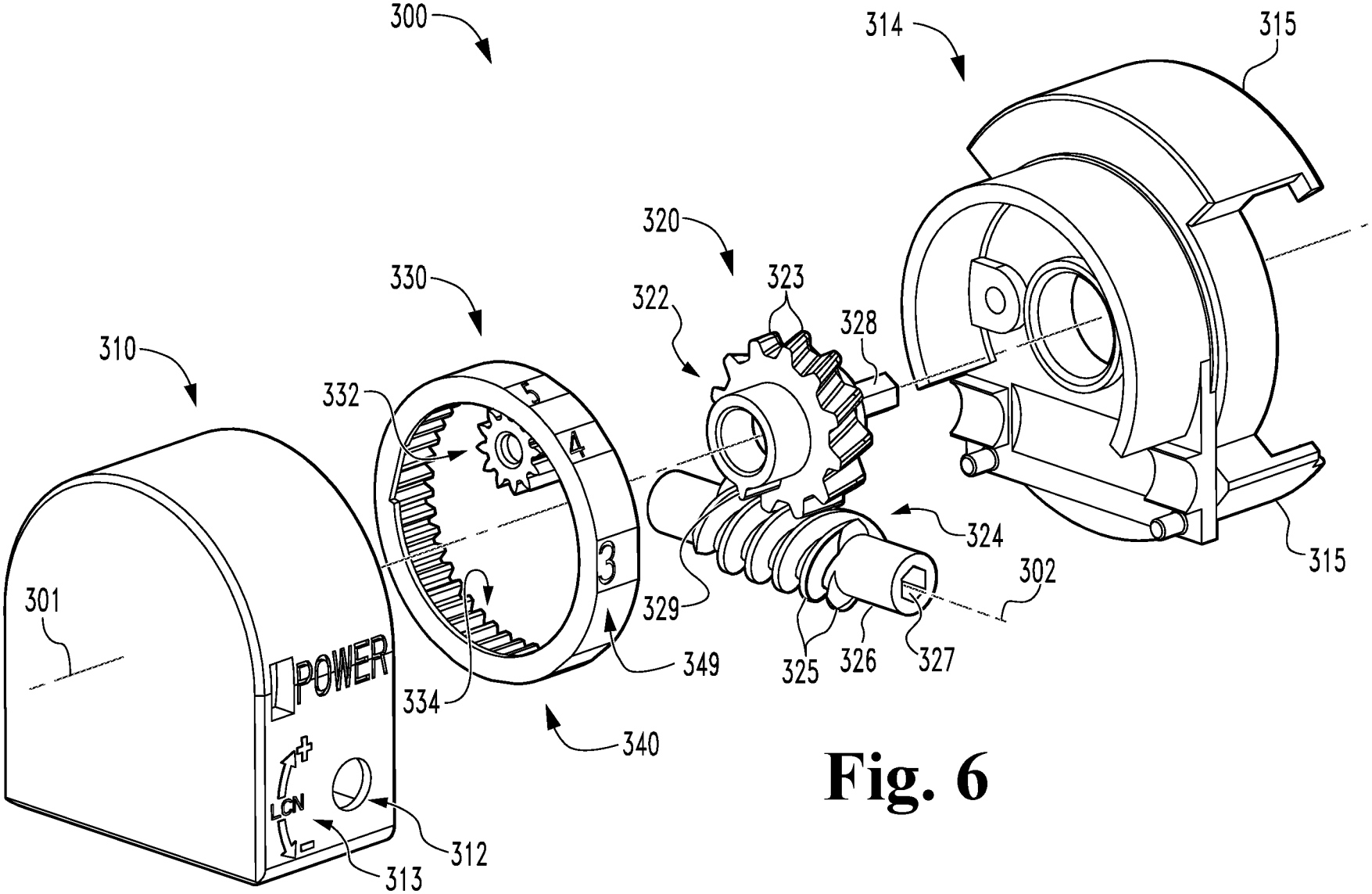
FIG. 6 is an exploded assembly view of an adjustment indicator mechanism according to certain embodiments.

With additional reference to FIG. 6, illustrated therein is an adjustment indicator mechanism 300 according to certain embodiments, which is an example of the adjustment indicator mechanism 150. The adjustment indicator mechanism 300 includes a housing 310, an adjustment transmission 320, an indicator transmission 330, and an indicator 340, which respectively correspond to the housing 151, the adjustment transmission 152, the indicator transmission 153, and the indicator 154.

In the illustrated form, the housing 310 includes a case 311 and a cover 314 mounted to the case 311. The housing 310 includes an aperture 312 through which the adjustment transmission 320 can be manipulated with a tool, such as a hex key. The housing 310 may further include indicia 313 relating to the manner in which the adjustment transmission 320 can be manipulated to increase and/or decrease the size of the door closer 100. The housing 310 is configured for mounting to the proximal end 112 of the closer housing 110, and may include features that facilitate such mounting. For example, the cover 314 may include a plurality of flanges 315 that snap onto or otherwise engage the proximal end 112. The case 311 further includes a window 318 through which a portion of the indicator 340 is visible.

The adjustment transmission 320 is mounted in the housing 310, and includes a worm gear 322 and a worm 324 engaged with the worm gear 322. More particularly, teeth 323 of the worm gear 322 are meshed with threads 325 of the worm 324 such that rotation of the worm 324 about a lateral axis 302 causes a corresponding rotation of the worm gear 322 about a longitudinal axis 301. The worm gear 322 includes a post 328 configured to matingly engage the head of the adjustment screw 144, and at least one additional tooth 329 operable to engage the indicator transmission 330. The worm 324 includes a head 326 defining a recess 327 sized and shaped to receive the tip of an adjustment tool, such as a hex key. The head 326 is accessible via the aperture 312 such that a user is able to insert the tip of the adjustment tool into the recess 327 to rotate the worm 324.

The indicator transmission 330 operably couples the adjustment transmission 320 with the indicator 340 such that movement of the adjustment transmission 320 is operable to cause movement of the indicator 340. The illustrated indicator transmission 330 includes a ring gear 334 formed on a radially-inner side of the indicator 340, and at least one intermediate gear 332 engaged between the adjustment transmission 320 and the ring gear 334. In other forms, the ring gear 334 may be directly engaged with the adjustment transmission 320. The intermediate gear 332 is operable to be engaged by the at least one additional tooth 329 of the adjustment transmission 320 such that rotation of the worm gear 322 through one full rotation causes at least some rotation of the intermediate gear 332, which in turn causes a corresponding rotation of the ring gear 334 and therefore the indicator 340.

The indicator 340 is substantially annular, and has the ring gear 334 formed on a radially-inner side thereof. The radially-outer side of the indicator 340 includes a plurality of indicia 349, each indicium corresponding to a respective size of the door closer 100. While other forms are contemplated, in the illustrated embodiment, the indicia 349 are numerical indicia. As the indicator 340 rotates about the longitudinal axis 301, the indicia 349 selectively become aligned with the window 318 such that the aligned indicium is visible via the window 318.

Figure 7:
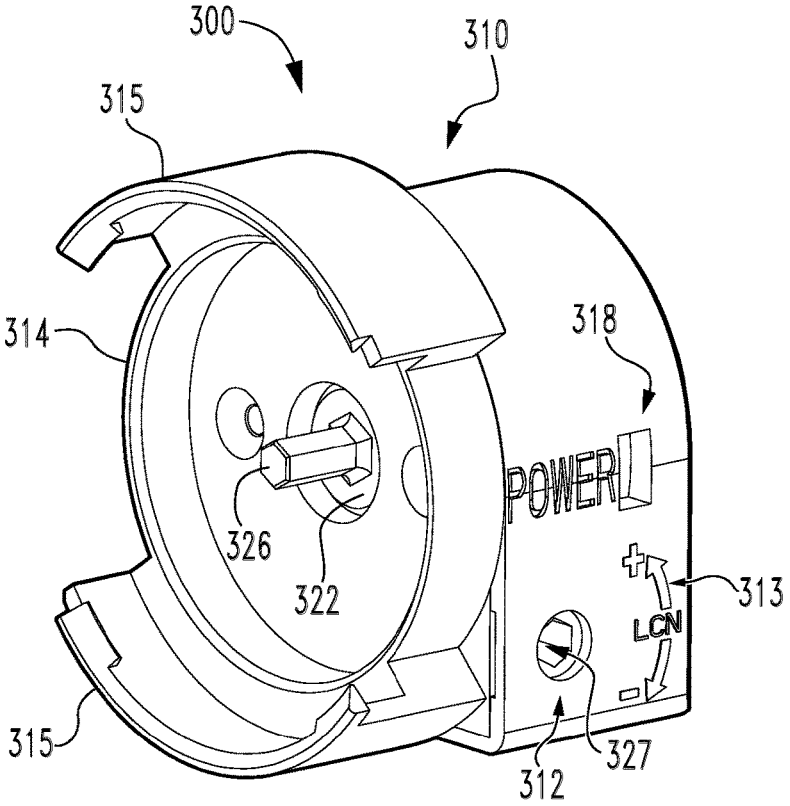
FIG. 7 is a perspective illustration of the adjustment indicator mechanism illustrated in FIG. 6.
Figure 8:
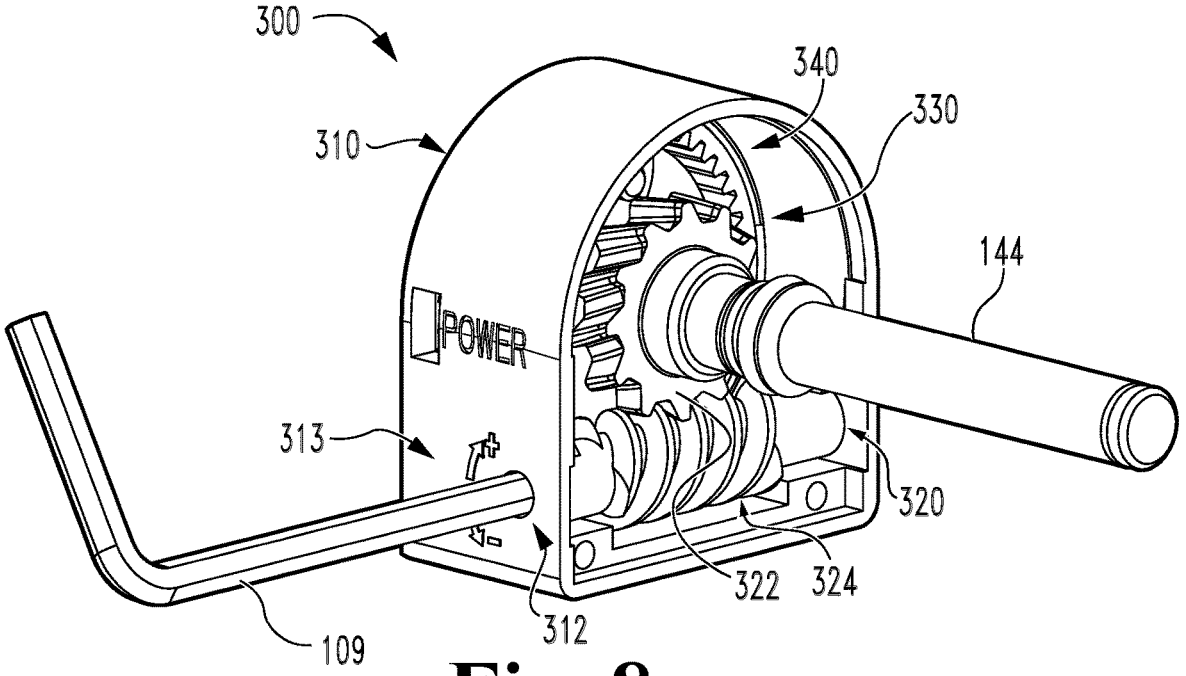
FIG. 8 is a perspective illustration of the adjustment indicator mechanism of FIG. 6 engaged with a tool and an adjustment screw of the door closer illustrated in FIG. 1.

With additional reference to FIGS. 7 and 8, the worm gear 322 is configured for coupling with the adjustment screw 144. For example, the worm gear 322 may include a post 328 sized and shaped to matingly engage the head 145 of the adjustment screw 144. When the adjustment indicator mechanism 300 is installed to the closer 100, manipulation of the adjustment transmission 320 by a tool 109 causes adjustment of the size of the closer 100 and a corresponding adjustment to the indicium displayed via the window 318.

More particularly, rotation of the worm 324 about the lateral axis 302 causes a corresponding rotation of the worm gear 322 about the longitudinal axis 301, thereby rotating the adjustment screw 144 and compressing or expanding the spring assembly 130. Rotation of the worm gear 322 also causes rotation of the indicator 340 such that when the door closer 100 reaches a particular size, the corresponding indicium 349 is displayed via the window 318.

During operation, the user may insert a tool 109 such as a hex key into the aperture 312 to engage the head 326 of the worm 324. The user may then rotate the tool 109 in a direction indicated by the indicia 313 to provide for a desired increase or decrease in the size of the door closer 100. Rotation of the worm 324 causes a corresponding rotation of the worm gear 322, thereby rotating the adjustment screw 144 and adjusting the size of the closer 100. Rotation of the worm gear 322 causes the additional tooth 329 to engage and rotate the intermediate gear 332, thereby rotating the indicator 340 and altering which of the indicia 349 is visible via the window 318. When the indicium corresponding to the desired size of the closer 100 is visible via the window 318, the user may cease rotating the tool 109.

In the illustrated embodiment, the worm gear 324 includes a tooth 329 that engages the intermediate gear 332 of the indicator transmission 330 to rotate the indicator transmission 330 and adjust the position of the indicator 340. It is also contemplated that the adjustment transmission 320 of the illustrated embodiment may be combined with a housing, indicator transmission, and indicator of the type illustrated in FIGS. 3-5. For example, the worm gear 324 may be rotationally coupled with the threaded sleeve 231 to longitudinally drive the indicator 240 along the housing 210.

Figure 9:
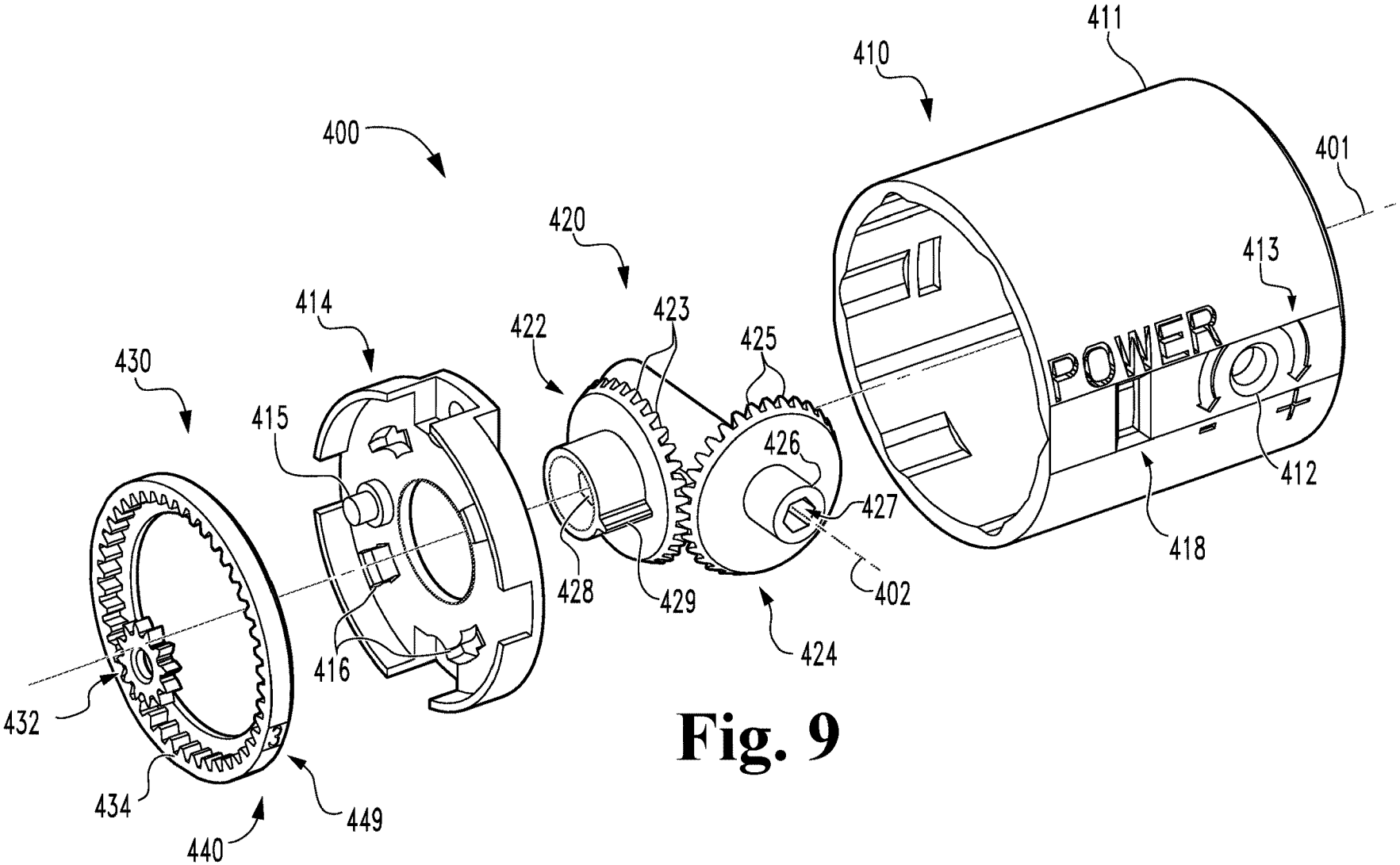
FIG. 9 is an exploded assembly view of an adjustment indicator mechanism according to certain embodiments.
Figure 10:
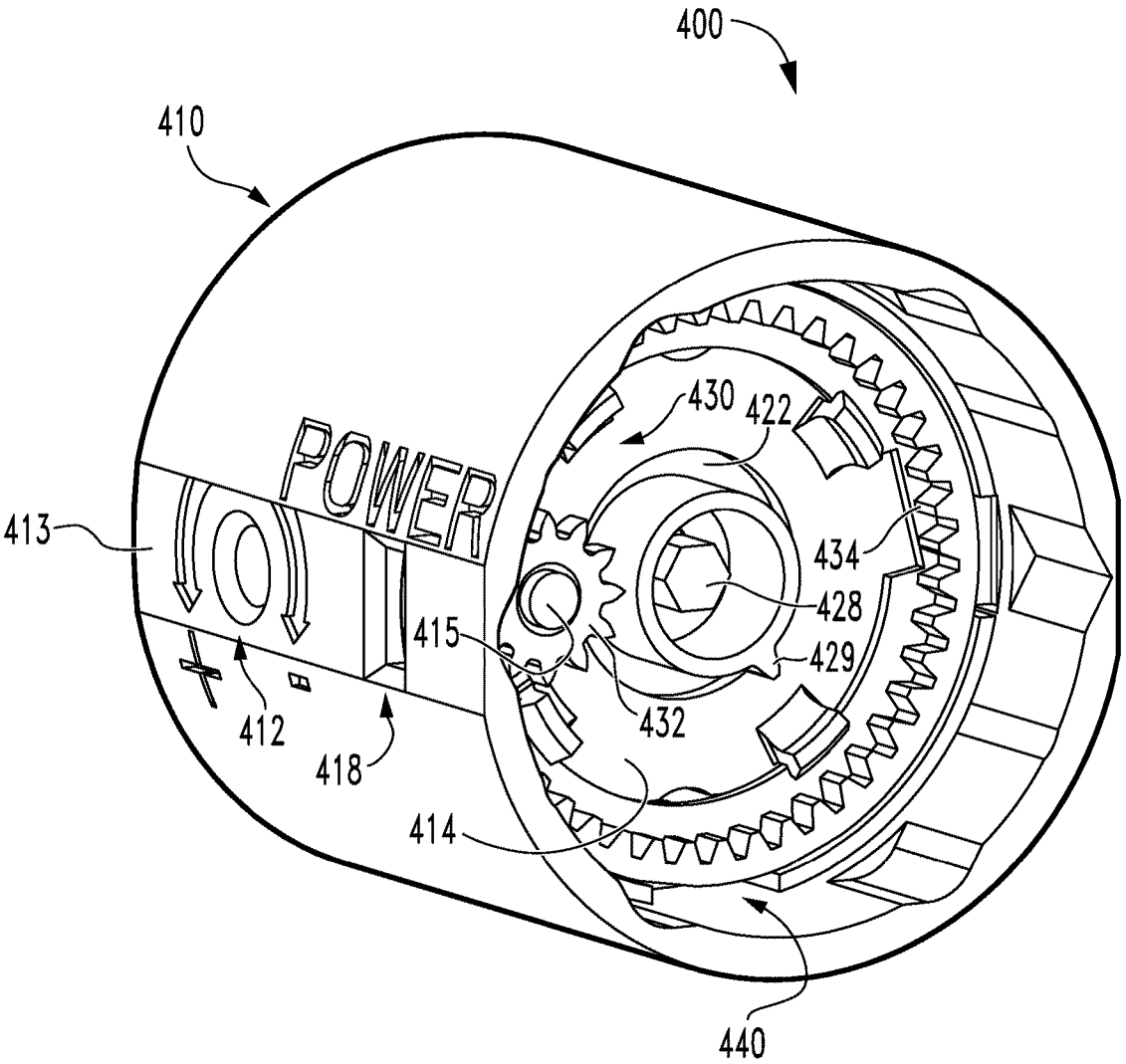
FIG. 10 is a perspective illustration of the adjustment indicator mechanism illustrated in FIG. 9.

With additional reference to FIGS. 9 and 10, illustrated therein is an adjustment indicator mechanism 400 according to certain embodiments, which is an example of the adjustment indicator mechanism 150. The adjustment indicator mechanism 400 includes a housing 410, an adjustment transmission 420, an indicator transmission 430, and an indicator 440, which respectively correspond to the housing 151, the adjustment transmission 152, the indicator transmission 153, and the indicator 154.

The housing 410 includes a case 411 and a cover 414 mounted to the case 411. The case 411 includes an aperture 412 through which the adjustment transmission 420 is accessible. The housing 410 may further include indicia 413 relating to the manner in which the adjustment transmission 420 can be manipulated to increase and/or decrease the size of the door closer 100. The housing 410 is configured for mounting to the proximal end 112 of the closer housing 110, and may include features that facilitate such mounting, such as grooves 417 sized to receive and engage the hexagonal end wall 113. The cover 414 is mounted in the case 411, and includes a post 415 and clips 416, which support the indicator transmission 430 and indicator 440.

The adjustment transmission 420 includes a first bevel gear 422 mounted for rotation about a longitudinal axis 401 and a second bevel gear 424 mounted for rotation about a lateral axis 402. The first bevel gear 422 includes teeth 423, the second bevel gear 424 includes teeth 425, and the teeth 423, 425 are meshed with one another such that rotation of the second bevel gear 424 about the lateral axis 402 causes a corresponding rotation of the first bevel gear 422 about the longitudinal axis 401. The second bevel gear 424 includes a head 426 defining a recess 427 operable to matingly engage the tip of a tool, such as a hex key. The first bevel gear 422 includes a post 428 operable to engage the head 145 of the adjustment screw 144, and at least one additional tooth 429 operable to engage the indicator transmission 430.

The indicator transmission 430 operably couples the adjustment transmission 420 with the indicator 440 such that movement of the adjustment transmission 420 is operable to cause movement of the indicator 440. The illustrated indicator transmission 430 includes a ring gear 434 formed on a radially-inner side of the indicator 440, and at least one intermediate gear 432 engaged between the adjustment transmission 420 and the ring gear 434. In other forms, the ring gear 434 may be directly engaged with the adjustment transmission 420. The intermediate gear 432 is operable to be engaged by the at least one additional tooth 429 of the adjustment transmission 420 such that rotation of the worm gear 422 through one full rotation causes at least some rotation of the intermediate gear 432, which in turn causes a corresponding rotation of the ring gear 434 and therefore the indicator 440.

The indicator 440 is substantially annular, and has the ring gear 434 formed on a radially-inner side thereof. The radially-outer side of the indicator 440 includes a plurality of indicia 449, each indicium corresponding to a respective size of the door closer 100. While other forms are contemplated, in the illustrated embodiment, the indicia 449 are numerical indicia. As the indicator 440 rotates about the longitudinal axis 401, the indicia 449 selectively become aligned with the window 418 such that the aligned indicium is visible via the window 418, thereby indicating the current size of the door closer 100.

During operation, the user may insert a tool 109 such as a hex key into the aperture 412 to engage the head 426 of the second bevel gear 424. The user may then rotate the tool 109 in a direction indicated by the indicia 413 to provide for a desired increase or decrease in the size of the door closer 100. Rotation of the second bevel gear 424 causes a corresponding rotation of the first bevel gear 422, thereby rotating the adjustment screw 144 and adjusting the size of the closer 100. Rotation of the first bevel gear 422 causes the additional tooth 429 to engage and rotate the intermediate gear 432, thereby rotating the indicator 440 and altering which of the indicia 449 is visible via the window 418. When the indicium corresponding to the desired size of the closer 100 is visible via the window 418, the user may cease rotating the tool 109.

In the illustrated embodiment, the first bevel gear 422 includes a tooth 429 that engages the intermediate gear 432 of the indicator transmission 430 to rotate the indicator transmission 430 and adjust the position of the indicator 440. It is also contemplated that the adjustment transmission 420 of the illustrated embodiment may be combined with a housing, indicator transmission, and indicator of the type illustrated in FIGS. 3-5. For example, the first bevel gear 422 may be rotationally coupled with the threaded sleeve 231 such that rotation of the first bevel gear 422 rotates the threaded sleeve 231 and longitudinally drives the indicator 240 along the housing 210 to selectively align the indicator 240 with the appropriate indicium 219.

Figure 11:
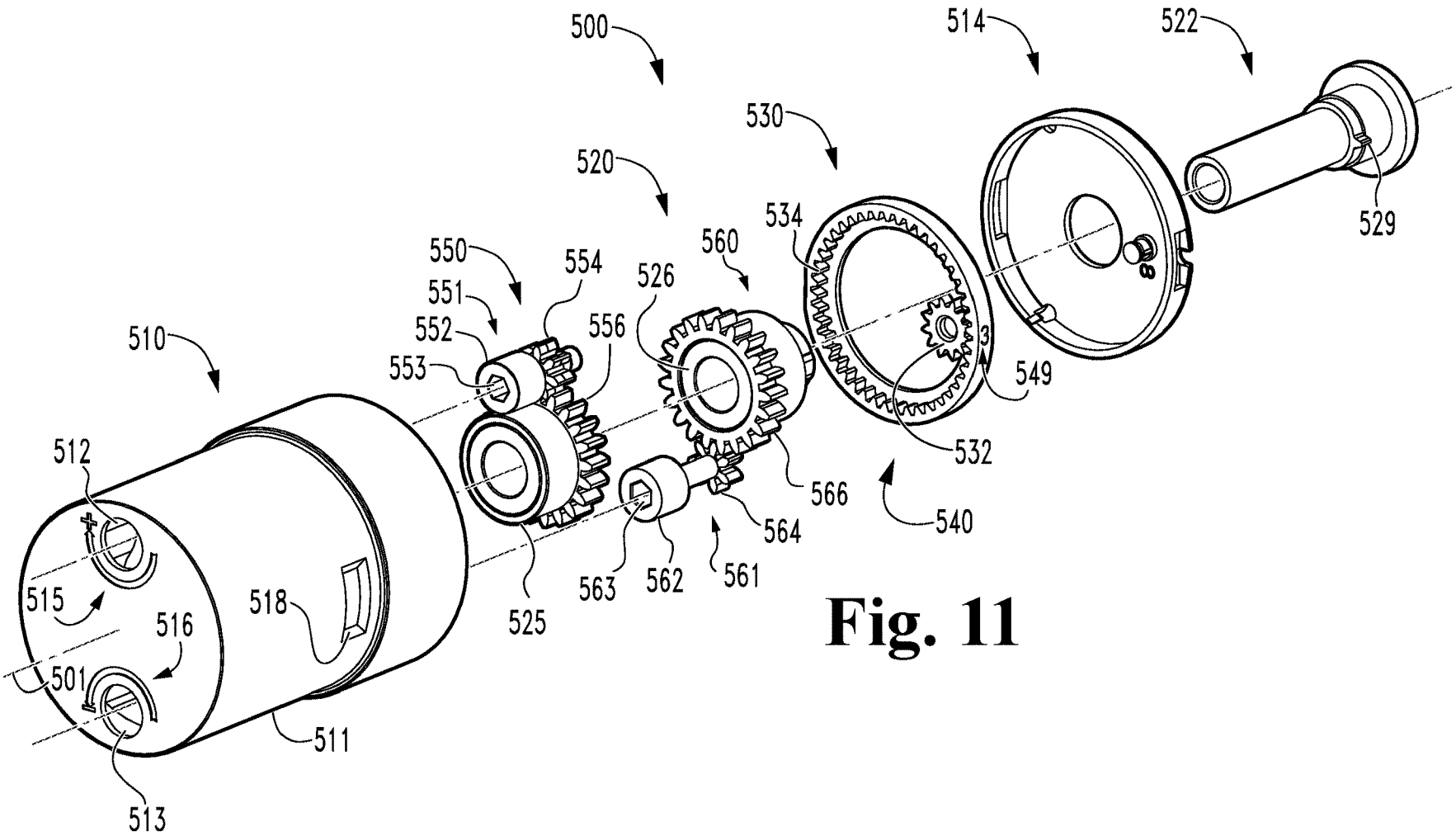
FIG. 11 is an exploded assembly view of an adjustment indicator mechanism according to certain embodiments.
Figure 12:
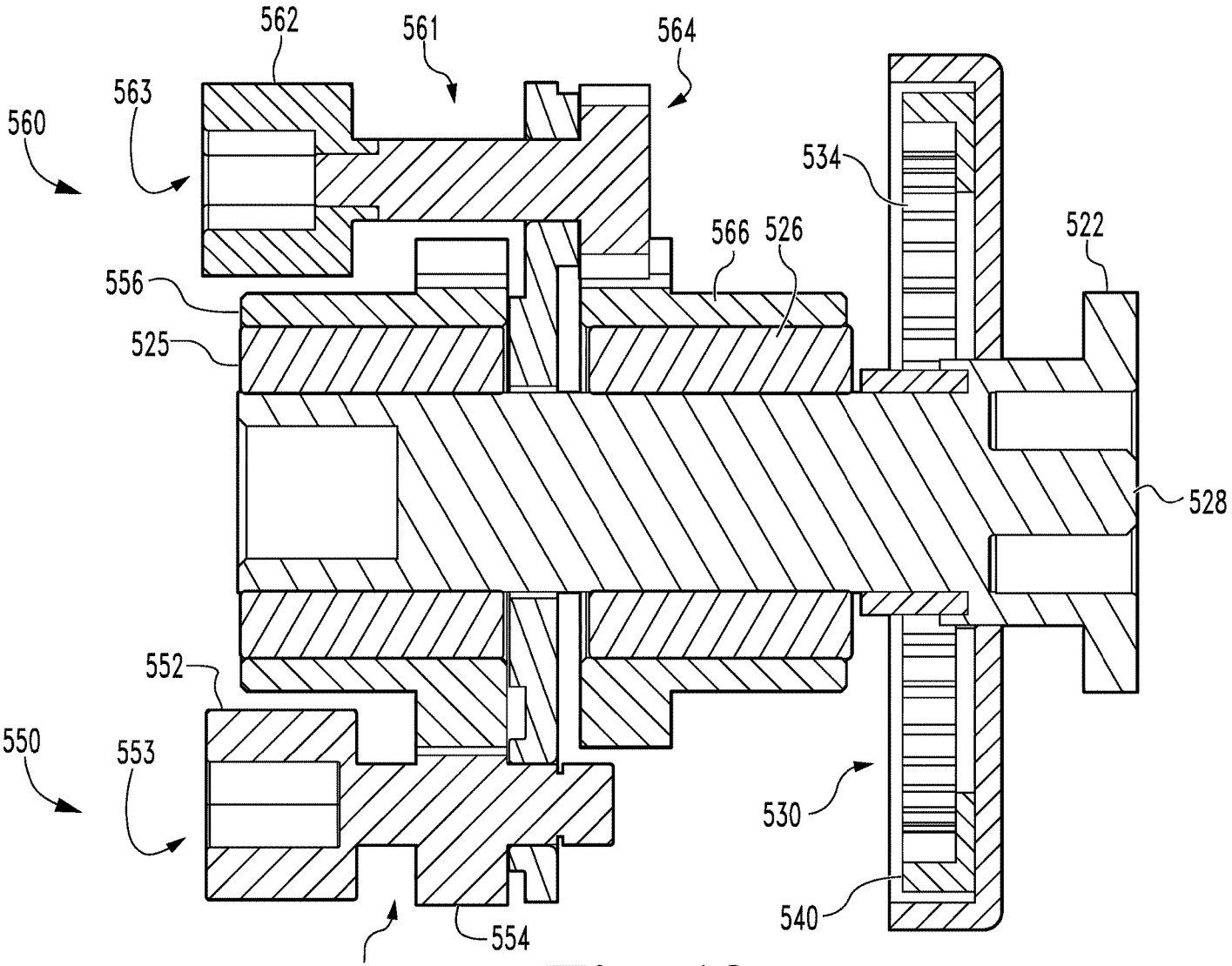
FIG. 12 is a cross-sectional view of a portion of the adjustment indicator mechanism illustrated in FIG. 11.

With additional reference to FIGS. 11 and 12, illustrated therein is an adjustment indicator mechanism 500 according to certain embodiments, which is an example of the adjustment indicator mechanism 150. The adjustment indicator mechanism 500 includes a housing 510, an adjustment transmission 520, an indicator transmission 530, and an indicator 540, which respectively correspond to the housing 151, the adjustment transmission 152, the indicator transmission 153, and the indicator 154. As described herein, the illustrated adjustment transmission 520 includes a first input gear train 550 operable to decrease the size of the door closer 100 and a second input gear train 560 operable to increase the size of the door closer 100.

The housing 510 includes a case 511 and a cover 514. The case 511 includes a first aperture 512 through which the first input gear train 550 is accessible with a tool, and a second aperture 513 through which the second input gear train 560 is accessible with the tool. The housing 510 also includes indicia 515 indicating that operating the first input gear train 550 serves to decrease the size of the door closer 100, and indicia 516 indicating that operating the second input gear train 560 serves to decrease the size of the door closer 100. The housing 510 further includes a window 518 through which a portion of the indicator 540 is visible.

The adjustment transmission 520 includes a transmission shaft 522, a first one-way bearing 525 engaged with the transmission shaft 522, a second one-way bearing 526 engaged with the transmission shaft 522, and at least one tooth 529 mounted to the transmission shaft 522 and operable to engage the indicator transmission 540. The adjustment transmission 520 further includes a first input gear train 550 engaged with the transmission shaft 522 via the first one-way bearing 525, and a second input gear train 560 engaged with the transmission shaft 522 via the second one-way bearing 526. The transmission shaft 522 is configured for coupling to the adjustment screw 144 such that rotation of the transmission shaft 522 causes a corresponding rotation of the adjustment screw. For example, the transmission shaft 522 may include a post 528 sized and shaped to matingly engage the head of the adjustment screw 144. As described herein, each of the one-way bearings 525, 526 is configured to transmit rotation of the corresponding input gear train 550, 560 to the transmission shaft in a single rotational direction such that each of the input gear trains 550, 560 is operable to rotate the transmission shaft 522 in a different rotational direction.

The indicator transmission 530 operably couples the adjustment transmission 520 with the indicator 540 such that movement of the adjustment transmission 520 is operable to cause movement of the indicator 540. The illustrated indicator transmission 530 includes a ring gear 534 formed on a radially-inner side of the indicator 540, and at least one intermediate gear 532 engaged between the adjustment transmission 520 and the ring gear 534. In other forms, the ring gear 534 may be directly engaged with the adjustment transmission 520. The intermediate gear 532 is operable to be engaged by the at least one additional tooth 529 of the adjustment transmission 520 such that rotation of the transmission shaft 522 through one full rotation causes at least some rotation of the intermediate gear 532, which in turn causes a corresponding rotation of the ring gear 534 and the indicator 540.

The indicator 540 is substantially annular, and has the ring gear 534 formed on a radially-inner side thereof. The radially-outer side of the indicator 540 includes a plurality of indicia 549, each indicium corresponding to a respective size of the door closer 100. While other forms are contemplated, in the illustrated embodiment, the indicia 549 are numerical indicia. As the indicator 540 rotates about the longitudinal axis 501, the indicia 549 selectively become aligned with the window 518 such that the aligned indicium is visible via the window 518, thereby indicating the current size of the door closer 100.

The first input gear train 550 includes an input member 551 including a head 552 and an input gear 554, and further includes a transmission gear 556 meshed with the input gear 554. The head 552 includes a recess 553 operable to receive the tip of a tool (e.g., a hex key) by which the first input gear train 550 can be manipulated. The transmission gear 556 is operably connected with the transmission shaft 522 via the first one-way bearing 525. The first one-way bearing 525 is configured to rotationally couple the transmission gear 556 with the transmission shaft 522 for joint rotation in one rotational direction, while permitting the transmission gear 556 to rotate relative to the transmission shaft 522 in the opposite rotational direction. More particularly, the first one-way bearing 525 is configured such that rotation of the transmission gear 556 in the size-decreasing direction causes a corresponding rotation of the transmission shaft 522 in the size-decreasing direction, and such that rotation of the transmission gear 556 in the size-increasing direction is not transmitted to the transmission shaft 522. Thus, the first input gear train 550 is operable to decrease the size of the closer 100, and is inoperable to increase the size of the closer 100. Accordingly, the first input gear train 550 may alternatively be referred to as the size-decreasing gear train 550.

The second input gear train 560 includes an input member 561 including a head 562 and an input gear 564, and further includes a transmission gear 566 meshed with the input gear 564. The head 562 includes a recess 563 operable to receive the tip of a tool (e.g., a hex key) by which the second input gear train 560 can be manipulated. The transmission gear 566 is operably connected with the transmission shaft 522 via the second one-way bearing 526. The second one-way bearing 526 is configured to rotationally couple the transmission gear 566 with the transmission shaft 522 for joint rotation in one rotational direction, while permitting the transmission gear 566 to rotate relative to the transmission shaft 522 in the opposite rotational direction. More particularly, the second one-way bearing 526 is configured such that rotation of the transmission gear 566 in the size-increasing direction causes a corresponding rotation of the transmission shaft 522 in the size-increasing direction, and such that rotation of the transmission gear 566 in the size-decreasing direction is not transmitted to the transmission shaft 522. Thus, the second input gear train 560 is operable to increase the size of the closer 100, and is inoperable to decrease the size of the closer 100. Accordingly, the second input gear train 560 may alternatively be referred to as the size-increasing gear train 560.

During operation, a user may desire to decrease the size of the door closer 100. In order to do so, the user may insert the tip of a tool (e.g., a hex key) into the head 552 of the size-decreasing gear train 550, and rotate the tool to drive the input member 551 in a first rotational direction. Such rotation of the input member 551 in the first rotational direction causes a corresponding rotation of the transmission gear 556 in the size-decreasing direction, thereby rotating the transmission shaft 522 in the size-decreasing direction. The user may then maintain engagement between the tool and the head 552 while rotating the tool in a second rotational direction opposite the first rotational direction, thereby rotating the transmission gear 556 in the size-increasing direction. Such rotation is not transmitted to the transmission shaft 522 however, due to the configuration of the first one-way bearing 525. Thus, the user may indiscriminately rotate the tool back and forth while being assured that the only rotation being transmitted to the transmission shaft 522 (and thus to the adjustment screw 144) is rotation that decreases the size of the door closer 100. As the transmission shaft 522 rotates, the tooth 529 engages the indicator transmission 530 and rotates the indicator 540 to selectively align the indicia 549 with the window 518. When the displayed indicium matches the desired size, the user may stop rotating the tool back and forth, as the door closer 100 is of the size corresponding to the displayed indicium.

Conversely, a user may desire to increase the size of the door closer 100. In order to do so, the user may insert the tip of a tool (e.g., a hex key) into the head 562 of the size-increasing gear train 560, and rotate the tool to drive the input member 561 in the second rotational direction. Such rotation of the input member 561 in the second rotational direction causes a corresponding rotation of the transmission gear 566 in the size-increasing direction, thereby rotating the transmission shaft 522 in the size-increasing direction. The user may then maintain engagement between the tool and the head 562 while rotating the tool in the first rotational direction, thereby rotating the transmission gear 566 in the size-decreasing direction. Such rotation is not transmitted to the transmission shaft 522 however, due to the configuration of the second one-way bearing 526. Thus, the user may indiscriminately rotate the tool back and forth while being assured that the only rotation being transmitted to the transmission shaft 522 (and thus to the adjustment screw 144) is rotation that increases the size of the door closer 100. As the transmission shaft 522 rotates, the tooth 529 engages the indicator transmission 530 and rotates the indicator 540 to selectively align the indicia 549 with the window 518. When the displayed indicium matches the desired size, the user may stop rotating the tool back and forth, as the door closer 100 is of the size corresponding to the displayed indicium.

In the illustrated embodiment, the transmission shaft 522 includes a tooth 529 that engages the intermediate gear 532 of the indicator transmission 530 to rotate the indicator transmission 530 and adjust the position of the indicator 540. It is also contemplated that the adjustment transmission 520 of the illustrated embodiment may be combined with a housing, indicator transmission, and indicator of the type illustrated in FIGS. 3-5. For example, the transmission shaft 522 may be rotationally coupled with the threaded sleeve 231 such that rotation of the transmission shaft 522 rotates the threaded sleeve 231 and longitudinally drives the indicator 240 along the housing 210 to selectively align the indicator 240 with the appropriate indicium 219.

Figure 13:
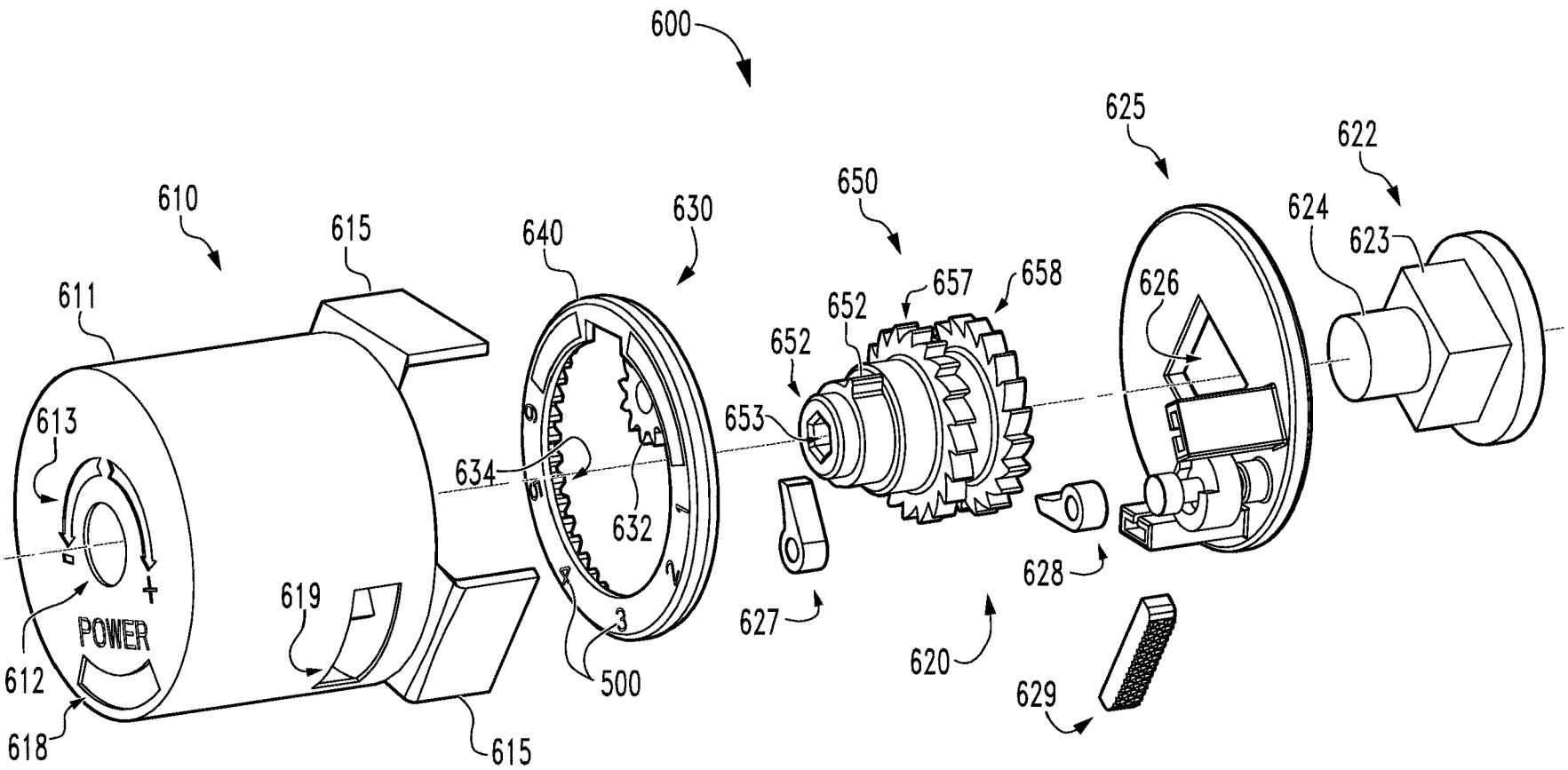
FIG. 13 is an exploded assembly view of an adjustment indicator mechanism according to certain embodiments.

With additional reference to FIG. 13, illustrated therein is an adjustment indicator mechanism 600 according to certain embodiments, which is an example of the adjustment indicator mechanism 150. The adjustment indicator mechanism 600 includes a housing 610, an adjustment transmission 620, an indicator transmission 630, and an indicator 640, which respectively correspond to the housing 151, the adjustment transmission 152, the indicator transmission 153, and the indicator 154. As described herein, the adjustment transmission 620 includes a tower 650 operable to rotate about a longitudinal axis 601 of the adjustment indicator mechanism 600.

The housing 610 includes a case 611, which includes an aperture 612 through which the adjustment transmission 620 can be manipulated by an appropriate tool, such as a hex key. The housing 610 may further include indicia 613 relating to the manner in which the adjustment transmission 620 can be manipulated to increase and/or decrease the size of the door closer 100. The housing 610 is configured for mounting to the proximal end 112 of the closer housing 110, and may include features that facilitate such mounting. For example, the case 611 may include a plurality of flanges 615 that snap onto or otherwise engage the end wall 113. The case 611 further includes a window 618 through which a portion of the indicator 640 is visible, and an opening 619 in which a portion of the adjustment transmission 620 is movably mounted.

The adjustment transmission 620 includes a transmission member 622, a holder 625 slidably mounted to and rotationally coupled with the transmission member 622, a first pawl 627 pivotably mounted to the holder 625, a second pawl 628 pivotably mounted to the holder 625, a toggle 629 supported by the holder 625, and a tower 650 rotatably supported by the transmission member 622. The adjustment transmission 620 may further include one or more springs 621 biasing the pawls 627, 628 toward the tower 650.

The transmission member 622 is configured for coupling with the adjustment screw 144, and includes a body portion 623 and a post 624 extending from the body portion 623. The holder 625 includes an aperture 626 that receives the body portion 623 of the transmission member 622 such that the holder 625 is rotationally coupled with the transmission member 622 and is axially slidable relative to the transmission member 622. Each of the pawls 627, 628 is pivotably mounted to the holder 625 and, as described herein, is operable to selectively engage the tower 650. The toggle 629 is seated in the opening 619 and is supported by the outer rim of the holder 625. As described herein, the toggle 629 facilitates axial shifting of the holder 625 between a first position and a second position.

The indicator transmission 630 operably couples the adjustment transmission 620 with the indicator 640 such that movement of the adjustment transmission 620 is operable to cause movement of the indicator 640. The illustrated indicator transmission 630 includes a ring gear 634 formed on a radially-inner side of the indicator 640, and at least one intermediate gear 632 engaged between the adjustment transmission 620 and the ring gear 634. In other forms, the ring gear 634 may be directly engaged with the adjustment transmission 620. The intermediate gear 632 is operable to be engaged by a tooth 659 of the adjustment transmission 620 such that rotation of the tower 650 through one full rotation causes at least some rotation of the intermediate gear 632, which in turn causes a corresponding rotation of the ring gear 634 and the indicator 640.

The indicator 640 is substantially annular, and has the ring gear 634 formed on a radially-inner side thereof. A front face of the indicator 640 includes a plurality of indicia 649, each indicium corresponding to a respective size of the door closer 100. While other forms are contemplated, in the illustrated embodiment, the indicia 649 are numerical indicia. As the indicator 640 rotates about the longitudinal axis 601, the indicia 649 selectively become aligned with the window 618 such that the aligned indicium is visible via the window 618, thereby indicating the current size of the door closer 100.

The tower 650 includes a head 652, a first ratchet wheel 657 operable to be engaged by the first pawl 627, a second ratchet wheel 658 operable to be engaged by the second pawl 628, and a tooth 659 operable to engage the indicator transmission 630. The head 652 includes a recess 653 operable to receive the tip of a tool (e.g., a hex key) by which the tower 650 can be rotated. As described herein, the first ratchet wheel 657 and the second ratchet wheel 658 are oriented in opposite rotational directions, and each is selectively operable to transmit rotation to the holder 625 via a corresponding one of the pawls 627, 628.

Figure 14:
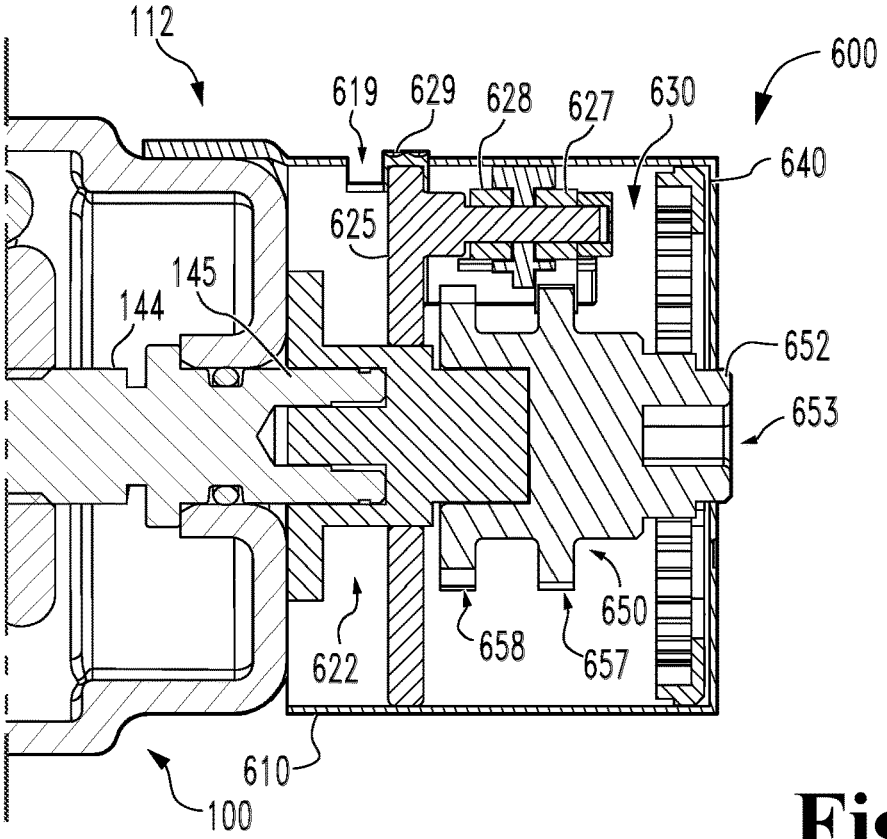
FIG. 14 is a cross-sectional view of the adjustment indicator mechanism illustrated in FIG. 13 while in a first state.
Figure 15:
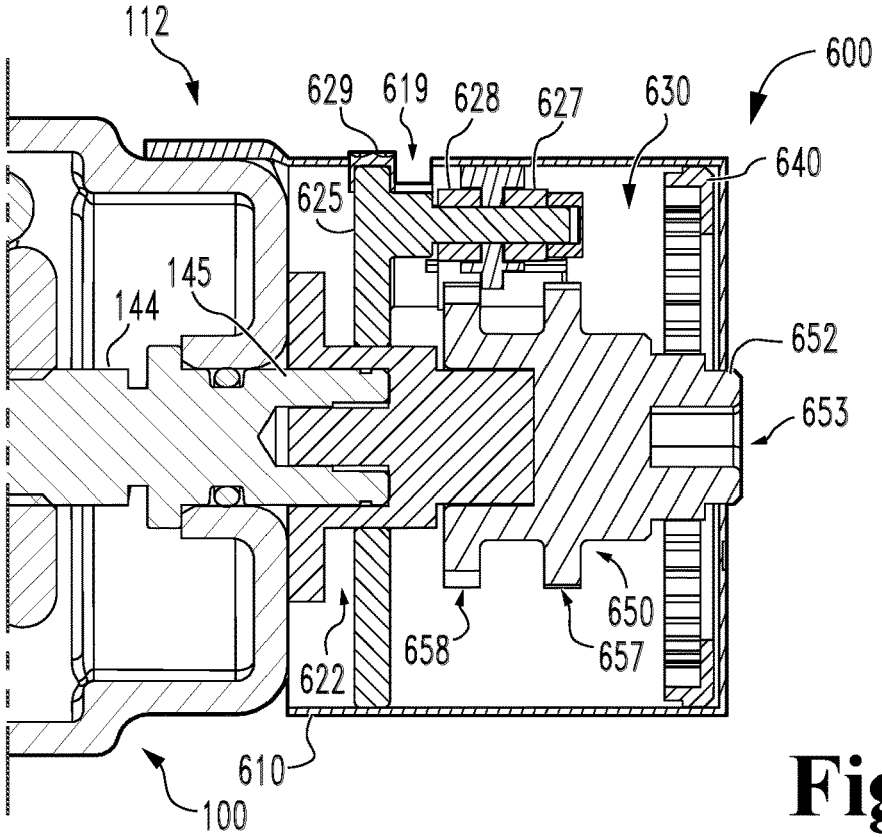
FIG. 15 is a cross-sectional view of the adjustment indicator mechanism illustrated in FIG. 13 while in a second state.

With additional reference to FIGS. 14 and 15, the holder 625 is axially slidable between a first position (FIG. 14) and a second position (FIG. 15) by moving the toggle 629 within the opening 619. When the holder 625 is in the first position (FIG. 14), the tower 650 is operable to rotate the holder 625 (and thus the transmission member 622 and the adjustment screw 144) in the size-decreasing direction, and is inoperable to rotate the holder 625 in the size-increasing direction. When the holder 625 is in the second position (FIG. 15), the tower 650 is operable to rotate the holder 625 (and thus the transmission member 622 and the adjustment screw 144) in the size-increasing direction, and is inoperable to rotate the holder 625 in the size-decreasing direction. As such, the adjustment indicator mechanism 600 may be considered to be in a size-decreasing configuration when the holder 625 is in the first position, and in a size-increasing configuration when the holder 625 is in the second position.

FIG. 14 illustrates the adjustment indicator mechanism 600 in the size-decreasing configuration, in which the holder 625 is in the first position. In this state, the first pawl 627 is engaged with the first ratchet wheel 657, and the second pawl 628 is disengaged from the second ratchet wheel 658. The first pawl 627 and the first ratchet wheel 657 are arranged such that rotation of the tower 650 in the size-decreasing direction causes the teeth of the first ratchet wheel 657 to catch the first pawl 627, thereby transmitting torque to the holder 625. Conversely, rotation of the tower 650 in the size-increasing direction causes the teeth of the first ratchet wheel 657 to pivot the first pawl 627 such that torque is not transmitted to the holder 625. Thus, when the adjustment indicator mechanism 600 is in the size-decreasing configuration, the user need not disengage the tool from the head 652 of the tower 650, and can simply rotate the tool back and forth to cause the adjustment indicator mechanism 600 to decrease the size of the door closer 100.

FIG. 15 illustrates the adjustment indicator mechanism 600 in the size-increasing configuration, in which the holder 625 is in the second position. In this state, the first pawl 627 is disengaged from the first ratchet wheel 657, and the second pawl 628 is engaged with the second ratchet wheel 658. The second pawl 628 and the second ratchet wheel 658 are arranged such that rotation of the tower 650 in the size-increasing direction causes the teeth of the second ratchet wheel 658 to catch the first pawl 628, thereby transmitting torque to the holder 625. Conversely, rotation of the tower 650 in the size-decreasing direction causes the teeth of the second ratchet wheel 658 to pivot the second pawl 628 such that torque is not transmitted to the holder 625. Thus, when the adjustment indicator mechanism 600 is in the size-increasing configuration, the user need not disengage the tool from the head 652 of the tower 650, and can simply rotate the tool back and forth to cause the adjustment indicator mechanism 600 to increase the size of the door closer 100.

In the illustrated embodiment, the tower 650 includes a tooth 659 that engages the intermediate gear 632 of the indicator transmission 630 to rotate the indicator transmission 630 and adjust the position of the indicator 640. It is also contemplated that the adjustment transmission 620 of the illustrated embodiment may be combined with a housing, indicator transmission, and indicator of the type illustrated in FIGS. 3-5. For example, the transmission member 622 may be rotationally coupled with the threaded sleeve 231 such that rotation of the transmission member 622 rotates the threaded sleeve 231 and longitudinally drives the indicator 240 along the housing 210 to selectively align the indicator 240 with the appropriate indicium 219.

It should be appreciated that the concepts described herein can be combined in arrangements not specifically illustrated in FIGS. 3-15. For example, the adjustment transmission of one embodiment may be combined with the indicator transmission and indicator of another embodiment. Thus, the adjustment indicator mechanism 150 illustrated in FIGS. 1 and 2 may include any combination of features illustrated and described in connection with the embodiments illustrated in FIGS. 3-15. By way of example, the housing 151 may include a channel and indicia of the type illustrated in connection with the housing 210, the indicator transmission 153 may include a threaded sleeve of the type illustrated in connection with the indicator transmission 230, and the indicator 154 may be provided in the form of a slide of the type illustrated in connection with the indicator 240. In such forms, the adjustment transmission 152 may be of the type including a worm and worm gear (such as the adjustment transmissions 220, 320 illustrated in FIGS. 3-8), of the type including a pair of bevel gears (such as the adjustment transmission 420 illustrated in FIGS. 9 and 10), of the type including one-way bearings (such as the adjustment transmission 520 illustrated in FIGS. 11 and 12), or of the type including a ratchet-and-pawl mechanism (such as the adjustment transmission 620 illustrated in FIGS. 13-15). Additionally, while an exemplary form of the door closer 100 is illustrated in and described with reference to FIG. 1, it should be appreciated that the adjustment indicator mechanisms described herein may be utilized in connection with other forms of door closers.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door closer, comprising:

a closer body;

a rack movably mounted in the closer body;

a pinion rotatably mounted in the closer body and engaged with the rack;

a spring mounted in the closer body and exerting a biasing force on the rack;

an adjustment screw rotatably mounted to the closer body, wherein rotation of the adjustment screw about a longitudinal axis adjusts the biasing force exerted on the rack by the spring;

a housing mounted to the closer body, the housing including a window extending through a wall of the housing;

an adjustment transmission coupled with the adjustment screw, wherein manipulation of the adjustment transmission rotates the adjustment screw about the longitudinal axis to adjust the biasing force exerted on the rack by the spring, and wherein the adjustment transmission comprises a threaded sleeve; and an indicator transmission engaged with the adjustment transmission such that the manipulation of the adjustment transmission drives the indicator transmission, the indicator transmission comprising an indicator having one or more indicia, the indicator mounted in the housing such that the one or more indicia of the indicator is visible through the window to provide a visual indication of a current size of the door closer; and wherein the indicator is captured between the housing and the threaded sleeve such that the housing prevents rotation of the indicator relative to the closer body.

2. The door closer of claim 1, wherein the adjustment transmission comprises:

a worm gear engaged with the adjustment screw such that rotation of the worm gear causes a corresponding rotation of the adjustment screw; and a worm engaged with the worm gear such that rotation of the worm causes a corresponding rotation of the worm gear.

3. The door closer of claim 2, wherein the worm gear is rotationally coupled with the adjustment screw for rotation about the longitudinal axis, and wherein the worm is mounted for rotation about a lateral axis transverse to the longitudinal axis.

4. The door closer of claim 1, wherein the adjustment transmission comprises:

a first component rotationally coupled with the adjustment screw; and a second component operably connected with the first component such that the second component is at least selectively operable to rotate the first component.

5. The door closer of claim 4, wherein the first component comprises a worm gear, and wherein the second component comprises a worm engaged with the worm gear.

6. The door closer of claim 1, further comprising second indicia on an outer surface of the housing adjacent the window, the second indicia corresponding to a plurality of sizes of the door closer; and wherein the one or more indicia of the indicator is selectively aligned with one of the second indicia to provide the visual indication of the current size of the door closer.

7. The door closer of claim 6, wherein the window comprises a longitudinally-extending channel and the second indicia are positioned alongside the channel.

8. A door closer, comprising:

a door closer body;

a rack movably mounted in the door closer body;

a pinion rotatably mounted in the door closer body and engaged with the rack;

a spring mounted in the door closer body and exerting a biasing force on the rack;

an adjustment screw rotatably mounted to the door closer body such that rotation of the adjustment screw adjusts the biasing force exerted on the rack by the spring;

a housing mounted to the door closer body, the housing comprising a window extending through a wall of the housing;

a threaded sleeve mounted within the housing; and an indicator having one or more indicia, the indicator movably mounted in the housing such that the one or more indicia of the indicator is visible through the window to provide a visual indication of a current size of the door closer; and wherein the indicator is captured between the housing and the threaded sleeve such that the housing prevents rotation of the indicator relative to the door closer body.

9. The door closer of claim 8, further comprising an adjustment transmission mounted in the housing, wherein the adjustment transmission includes a first component configured for coupling with the adjustment screw such that the adjustment transmission is operable to rotate the adjustment screw.

10. The door closer of claim 9, wherein the first component comprises a worm gear engaged with the adjustment screw such that rotation of the worm gear causes a corresponding rotation of the adjustment screw; and wherein the adjustment transmission further comprises a worm engaged with the worm gear such that rotation of the worm causes a corresponding rotation of the worm gear.

11. The door closer of claim 10, wherein the worm gear is rotationally coupled with the adjustment screw for rotation about a longitudinal axis, and wherein the worm is mounted for rotation about a lateral axis transverse to the longitudinal axis.

12. The door closer of claim 9, wherein the adjustment transmission further comprises a second component operably connected with the first component such that the second component is at least selectively operable to rotate the first component; and wherein the first component comprises one of a worm gear or a worm, and wherein the second component comprises another of the worm gear or the worm.

13. The door closer of claim 8, wherein the indicator is arcuate and has a radially-inner side and a radially-outer side, the radially-inner side of the indicator is threaded and is engaged with threads of the threaded sleeve, and the radially-outer side of the indicator includes the one or more indicia.

14. The door closer of claim 8, further comprising second indicia on an outer surface of the housing adjacent the window, the second indicia corresponding to a plurality of sizes of the door closer; and wherein the one or more indicia of the indicator is selectively aligned with one of the second indicia to provide the visual indication of the current size of the door closer.

15. The door closer of claim 14, wherein the window comprises a longitudinally-extending channel and the second indicia are positioned alongside the channel.

* * * * *